US005351351A

United States Patent [19]

Ono

[11] Patent Number: 5,351,351

[45] Date of Patent: Oct. 4, 1994

[54] METHOD OF DYEING YARN CHEESES

[75] Inventor: Nobutaka Ono, Ashiya, Japan

[73] Assignee: Osaka Bobbin Co., Ltd., Osaka, Japan

[21] Appl. No.: 65,354

[22] Filed: May 21, 1993

[30] Foreign Application Priority Data

Jun. 9, 1992 [JP] Japan ..... 4-176055

[51] Int. Cl.[5] ..... D06B 5/18

[52] U.S. Cl. ..... 8/155.1; 68/198; 242/118.11

[58] Field of Search ..... 8/155.1, 155.2; 68/189, 68/198; 242/118.11

[56] References Cited

U.S. PATENT DOCUMENTS

| | | | |
|---|---|---|---|
| 1,960,183 | 5/1934 | Garey et al. | 8/155.1 |
| 2,092,126 | 9/1937 | Laird et al. | 8/155.1 |
| 3,936,009 | 2/1976 | Livingstone | 242/118.11 |
| 4,946,114 | 8/1990 | Becker et al. | 68/198 X |

*Primary Examiner*—Philip R. Coe

*Attorney, Agent, or Firm*—Flynn, Thiel, Boutell & Tanis

[57] ABSTRACT

In a method of dyeing yarn cheeses stacked on a spindle and pressed to a definite compression degree by flowing a dye liquor through the yarn layers, the dye liquor is flowed while undergoing pulsation in a minimized flow rate and a minimized flow pressure, thereby enabling even permeation of the dye liquor into yarn layers and accordingly, even dyeing.

5 Claims, 3 Drawing Sheets

METHOD OF DYEING YARN CHEESES

BACKGROUND OF THE INVENTION

1. Field of the Invention

This invention relates to a method of dyeing yarn cheeses which comprises winding up filaments or yarns on press bobbins, mounting and stacking the resulting yarn cheeses one upon another on a spindle, pressing the yarn cheeses and dyeing them.

2. Statement of Related Art

In dyeing of yarns or filaments, in the past, one of the greatest problems has been how evenly a dye liquor can be brought into contact with a material to be dyed, and various attempts have been made to solve the problem.

In the field of yarn dyeing, for instance, hank dyeing has been performed by forming yarns into hanks, hanging the hank yarns on a rod of a hank dyeing machine, and flowing a dye liquor through the hank yarns from the inside toward the outside thereof while revolving the hank yarns, whereby the dye liquor comes in even contact with the yarns and an even dyeing is attained. However, this method requires time-consuming laborious work in hanking, hank reeling and yarn connecting. Moreover, the dyeing process cannot be automatized, necessitating laborious work and is performed under poor working conditions. Because of the reasons above, cheese dyeing is currently superseding the hank dyeing.

When cheese dyeing is carried out, it has been the practice that as shown in the accompanying FIGS. *2a* and *2b*, yarns to be dyed are wound upon bobbins for dyeing to make parallel cheeses or cone cheeses (11) and they are piled on a spindle (12) one upon another while interposing a spacer (13) between each of the bobbins. Here, it is required to wind up the yarns softly and evenly in order that the resulting cheeses may be brought into even contact with a dye liquor.

However, shoulder parts of the cheeses where yarns are turned back or portions of the cheeses on which a tension due to winding up of the yarns concentrates have caused unevenness in winding density, which has resulted in uneven dyeing. As a consequence, in order to eliminate the drawbacks, efforts have been made to attain evenness in winding density as far as possible by, for example, levelling off the shoulder parts or performing soft winding by means of a to-and-fro motion or feed rollers.

Nevertheless it has not been possible to obviate unevenness in winding density, and consequently, it has been extremely difficult to pursue even dyeing characteristics, since a dye liquor flows smoothly through soft portions of the cheeses, but is difficult to flow through high-density portions of the cheeses.

In order to obviate the foregoing defects, a dyeing method by reason of compression has been contrived, wherein cheeses inserted on a spindle are axially pressed, with hard parts thereof not collapsed and soft parts thereof pressed. The compression makes the winding density of the cheeses constant as a whole and nearly equalizes the winding density, thus minimizing the dispersion or scattering in winding density produced among the cheeses, whereby the defects have been alleviated to a significant degree. Even with this method, however, the difference of dyeing power between inner yarn layers and outer yarn layers has not been solved completely.

In the circumstances above, the present inventor has conducted intensive investigation into causes for the dyeing power difference between inner and outer layers of yarns and found that a flow pressure, which is exerted on a dye liquor in order to permeate it into the yarn layers, impairs the cheese dyeing greatly. That is, a pump of a dyeing machine is designed so that in order to permeate a dye liquor through yarns of cheeses which are stacked in multiple tiers on a spindle and compressed axially, for example, with cotton yarns, a flow rate of 35 to 50 liter/min. per 1 kg of the cotton yarns may be given. When the dye liquor enters into yarn layers, a great resistance is produced by filter phenomenon because of the high flow rate, slowing down the flow velocity and as a result, an innermost yarn layer is partly dyed in a deep color, the middle yarn layers are dyed nearly evenly, and the outermost yarn layer and its vicinity are dyed in a thin color because the resistance due to yarn layers is smaller and the flow rate is faster.

In view of the present state of art as described above, the present invention is designed to obviate the foregoing defects by focusing the attention on the parameters of flow rate and flow pressure of a dye liquor for permeating it into yarn layers of cheeses which are stacked in multiple tiers and axially compressed, and more particularly by minimizing the flow rate and the flow pressure of a dye liquor and by taking note of pulsation action of the human's heart or the like which functions to circulate the blood up to the terminal capillaries.

Accordingly, it is a primary object of this invention to provide a method of dyeing yarn cheeses which enables it to obviate the difference in dyeing property between inner and outer yarn layers and to enhance even dyeing property of yarns in cheese dyeing.

SUMMARY OF THE INVENTION

The present invention suited to the aforementioned object consists in an improvement in a method of dyeing yarn cheeses which comprises mounting and stacking yarn cheeses, in which yarns are wound up on press bobbins compressible to a definite compression degree, one upon another on a liquid-tight spindle, pressing the cheeses and dyeing the pressed cheeses while flowing a dye liquor through them, and the improvement is characterized in that the dye liquor is flowed while giving pulsation thereto in a minimized flow rate and a minimized flow pressure to such a degree that the dye liquor can pass through yarn layers of the pressed cheeses.

Here, the flow rate and flow pressure of the dye liquor to be applied vary depending upon the quality and weight of yarns of cheeses to be dyed. In case of cotton yarns, it is preferred that the flow rate be on the order of 6–10 liter/min. per 1 kg of the yarns. In contrast, conventional method required a flow rate of 30–50 liter/minute per 1 kg of cotton yarns.

The means of giving pulsation to a dye liquor includes, for example, a power switch, a butterfly valve, an inverter, etc.

According to this invention, the flow rate and flow pressure of a dye liquor are so low that the difference in flow velocity between inner yarn layers and outer yarn layers is diminished, and consequently, nearly equalized permeation of the dye liquor through the inner and outer yarn layers is attained. The pulsation is given to the dye liquor in that equalized permeation state and hence, the dye liquor smoothly passes through the whole yarn layers. Thus, even dyeing is attained by equalized permeation of the dye liquor.

BRIEF DESCRIPTION OF THE DRAWINGS

The invention will be hereinbelow described in more detail with reference to the accompanying drawings by way of preferred embodiments.

FIG. 1' is a schematic front elevational view, partly omitted, of the press bobbin in FIG. 1 showing its compressed state;

FIG. *2a* and FIG. *2b* are schematic illustrations showing respectively parallel cheeses and cone cheeses in their multiply stacked and pressed state used for the method of this invention;

FIG. *3a* is a schematic view showing one example of a dyeing machine with which to carry out the method of this invention; and FIG. *3b* is a graphic representation showing examples of the change of flow rate with time obtained by pulsating means in FIG. *3a*.

DESCRIPTION OF THE PREFERRED EMBODIMENTS

Figure 1:
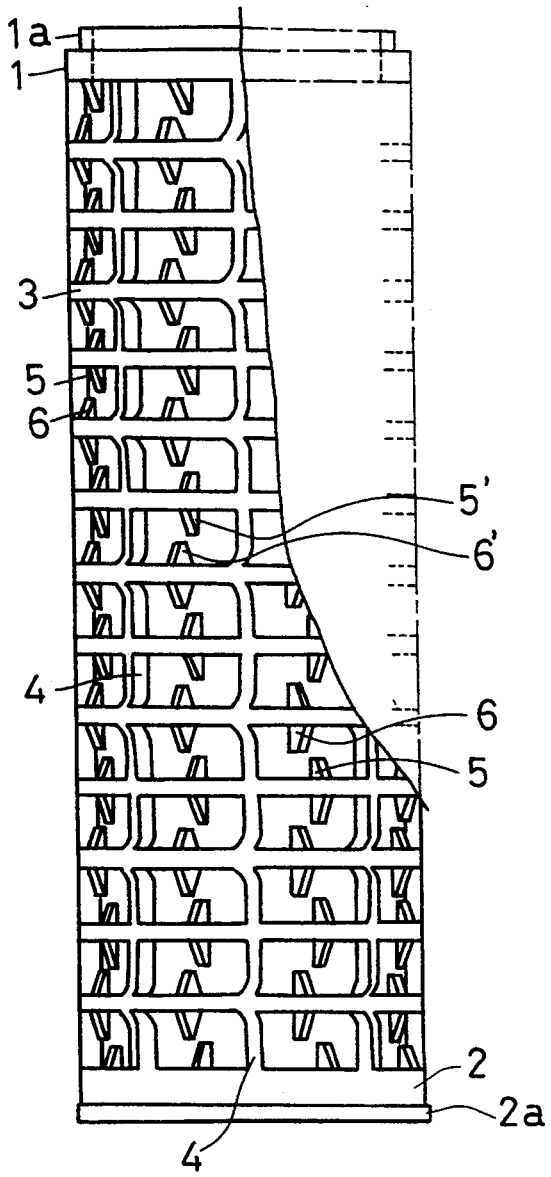
FIG. 1 is a schematic front elevational view, partly omitted, showing one example of a press bobbin for yarn cheeses used for the method of this invention.
Figure 1:
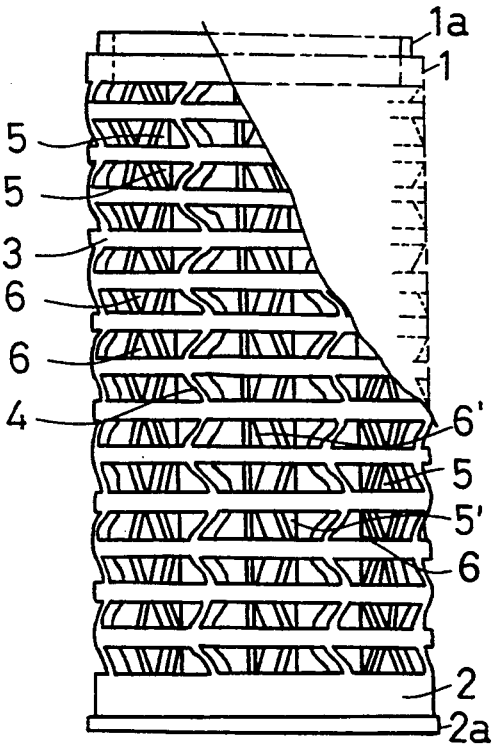
Figure 2A:
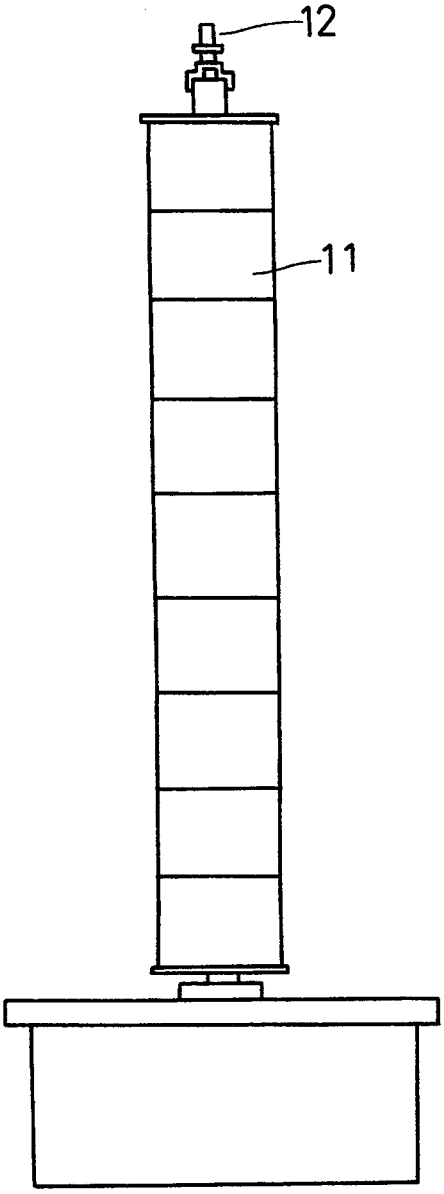
Figure 2B:
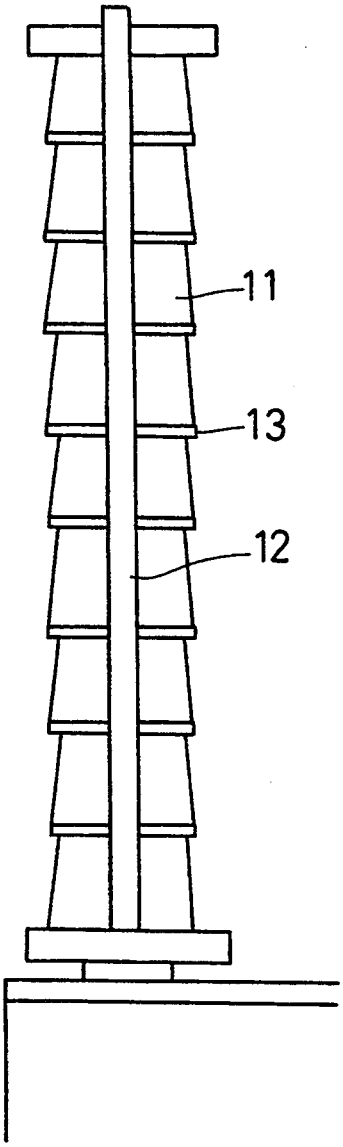
Figure 3B:
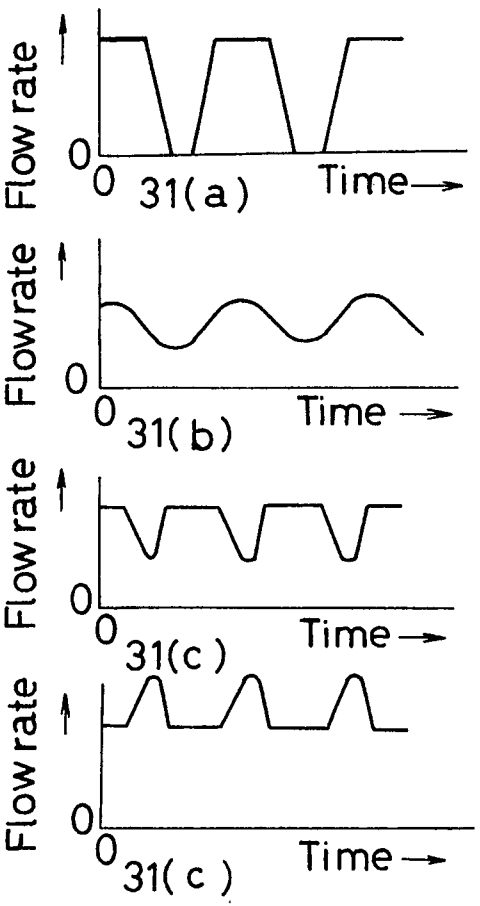
Figure 3A:
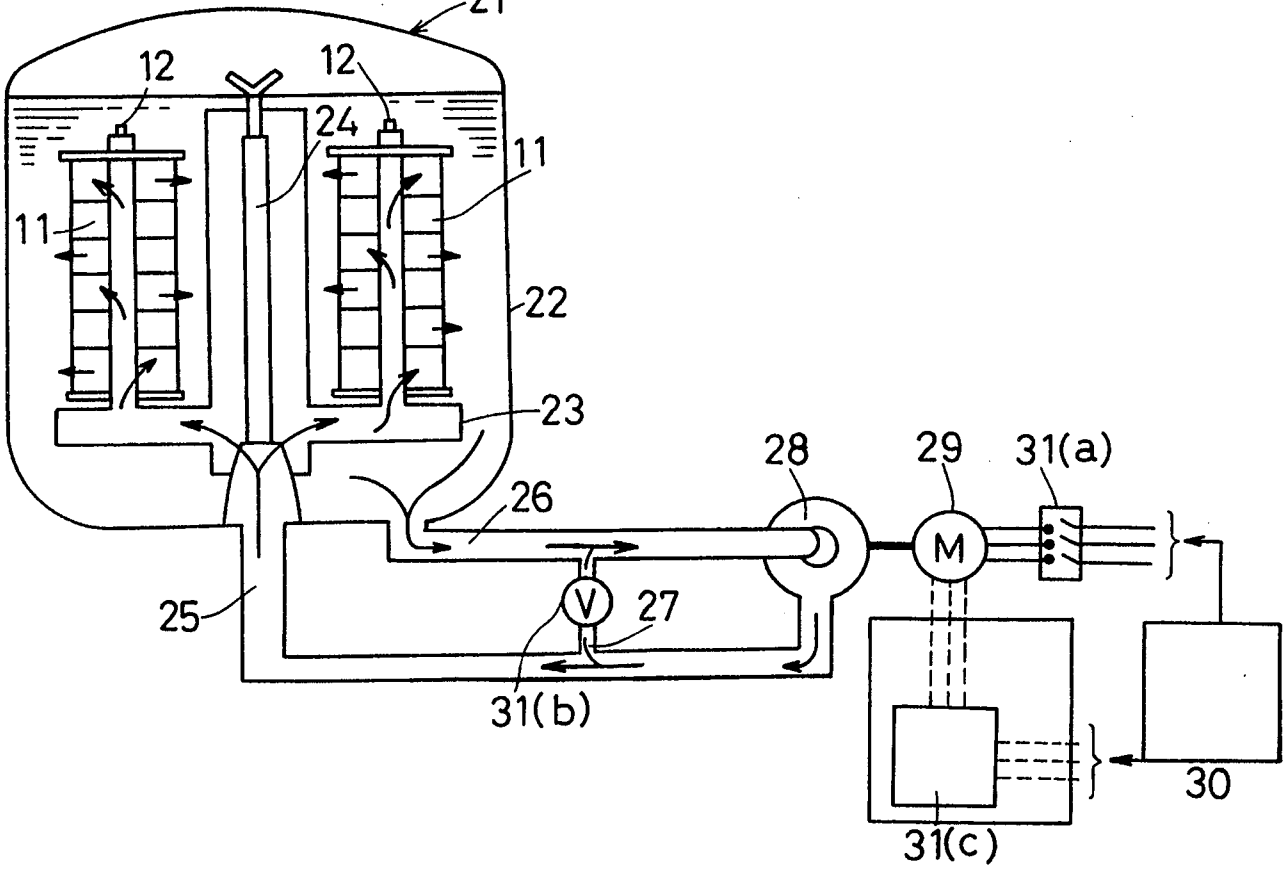

Referring to FIG. 1, one example of a press bobbin to be used for a dyeing method of this invention is shown, which is fabricated as a cylindrical body by integral molding of a thermoplastic synthetic resin such as polypropylene, polyethylene, polyamides, etc.

The press bobbin comprises rings 1,2 disposed opposite to each other at both ends of the bobbin; a plurality of longitudinal frames 4 extending, within a cylindrical contour plane involving the rings 1,2, circumferentially between the rings 1,2 so as to be disposed equidistantly; and annular transverse frames 3 extending in parallel with and between the rings 1,2 and disposed equidistantly in the planes orthogonally intersecting the longitudinal frames 4, thus forming a fundamental framework of the bobbin.

The upper and lower bobbins 1,2 are spaced apart a required distance in an opposed manner, thereby determining the length of bobbin and are formed, on their outer faces, to be flat and smooth. The top of the upper ring 1 and the bottom of the lower ring 2 are formed as a pair of upper and lower components *1a,2a*, respectively, that are capable of fitting to each other so that bobbins can readily be stacked one upon another.

The annular transverse frames 3,3 extending adjacent to each other are provided with longitudinal piece members 5 and 6 or 5' and 6' between any adjacent longitudinal frames 4,4. The longitudinal piece members 5,6 each extend above and below each annular transverse frame 3 up to respective midpoints between the adjacent annular transverse frames 3,3 and are staggered between adjacently disposed annular transverse frames 3,3 in series, thus forming two files, in the whole length of the bobbin, of longitudinal piece members 5,5 . . . and 6,6 . . . between any two adjacent longitudinal frames 4,4.

The longitudinal piece members 5 or 6 are, when pressed, opposed to one another in the same file of longitudinal piece members 5,5 . . . or 6,6 . . . as shown in FIG. 1' in a manner that one annular transverse frame 3 intervenes between the longitudinal piece members 5,5 or 6, 6, whereby the degree of compression is regulated.

In performing a dyeing treatment according to this invention by using the aforesaid press bobbins, first, yarns to be dyed are wound up on the bobbins; the resulting cheeses 11 are inserted on the spindle 12 and stacked one upon another as shown in FIG. *2a* and FIG. *2b;* axial compression is exerted on the stacked cheeses. At that time, a bobbin is compressed to the state shown in FIG. 1', wherein the longitudinal piece members 5,6 or 5',6' serve as stoppers until the compression is stopped, reaching a predetermined degree of compression, concurrently with which compression of the yarns wound on the bobbin is also stopped. Then the compression on one cheese is transferred in turn to the adjacent cheeses, which are likewise pressed to a definite degree of compression.

In this way, compression is transferred to the respective longitudinally intermediate zones of stacked bobbins from above and below, and accordingly, to the stacked cheeses, whereby a definite compression degree of the stacked cheeses as a whole is attained. In that compressed state of the cheeses 11, a dye liquor is flowed through the spindle 12 into the yarns thereof to perform dyeing treatment, according to which the dye liquor is flowed as a pulsating flow in a minimized flow rate and a minimized flow pressure.

One example of a dyeing machine 21 for carrying out the dyeing method of this invention is shown in FIG. *3a*.

The dyeing machine 21 comprises a tank 22 holding a dye liquor, in which a plurality of stacked and pressed cheeses 11 are mounted on a carrier 23 supported by a center pipe 24, an entry pipe 25 for incoming dye liquor, an outlet pipe 26 for outgoing dye liquor, a pump 28 for flowing and circulating the dye liquor, a motor 29 for driving the pump 28 and a power source 30 for the motor 29, and a pulsating means 31 for imparting pulsation to the dye liquor.

One example of the pulsating means 31 is a power switch 31(*a*), for intermittently switching on and off the electric source 30, which is installed between the motor 29 and the electric source 30 for the motor.

Another example of pulsating means is a butterfly valve 31(*b*) which serves to regulate the flow rate by changing its throttle degree and is located in a bypass pipe 27 interconnecting the pipes 25,26.

A further example of pulsating means is an inverter 31(*c*) installed between the motor 29 and the electric source 30, by means of which the flow rate of a dye liquor can be regulated by changing its output frequency. These examples 31(*a*), 31(*b*), 31(*c*) are illustrated in the same figure ( FIG. *3a* ) for convenience sake.

The pulsating flow obtained by the pulsating means 31(*a*) is periodically, intermittently flowed and not flowed whereas the pulsating flows obtained by the pulsating means 31(*b*) and 31(*c*) are flowed, changing the flow rate periodically in a more or less sinusoidal manner, as shown in FIG. *3b*.

It is naturally possible to vary the flowing manner of pulsating flow as illustrated by the graphic figures of FIG. *3b* according to the kinds of yarns and dye liquor used.

The dye liquor is circulated with the aid of the pump 28 in the direction of the arrow lines and flowed as a pulsating flow through the spindles 12 into the yarn layers in a minimized flow rate and a diminished flow pressure to the extent that the dye liquor can pass through the yarn layers of the compressed cheeses 11.

The pulsation flow, attended with a reduction in flow pressure contingent to the diminished flow rate, causes homogeneous cheese dyeing. If the flow rate is too large or the flow pressure is too high, the pulsation effect is deteriorated and a flow velocity differential remains between the inner and outer yarn layers.

A preferred range of flow rate of a dye liquor varies depending upon the kind and winding density of yarns and the kind of dye liquor. For example, for cotton yarns, a preferred flow rate of a dye liquor is in the range of 6 to 10 liter/min. per 1 kg of the cotton yarns in the invention whereas in a conventional method, the flow rate of the same dye liquor is usually 35 to 50 liter/min. per 1 kg. For polyester yarns, a preferred flow rate in this invention is in the range of 4 to 7 liter/-min. to the yarns having a winding density after pressing of 0.51 g/cm$^3$ and a winding density before pressing of 0.38 g/cm$^3$ whereas in a prior art method, the flow rate of the same dye liquor is usually in the neighborhood of 48 liter/min. to the yarns of the same winding densities. Thus the flow rate in this invention is only about one seventh to one seventh that of conventional cheese dyeing method.

According to the cheese dyeing method of this invention, the stacked press bobbins constituting the stacked cheeses can each cease to compress at a definite compression degree and transfer respective compression in turn to the other bobbins, and dyeing treatment can thus be applied to the stacked cheeses without causing any dyeing power differential between the inner and outer yarn layers thereof. That is, a dye liquor is flowed through the yarn layers of the pressed cheeses in a minimized flow rate and a diminished flow pressure while undergoing pulsation and consequently, permeation effect of the dye liquor into the yarn layers is enhanced, whereby equalized permeation or even permeation of the dye liquor in the inner and outer yarn layers of cheeses is expedited, and a homogeneous dyeing as a whole can be attained.

What is claimed is:

1. A method for dyeing yarn cheeses comprising the steps of: winding up yarns on press bobbins that are compressible to a predetermined degree of compression; mounting and stacking the resulting yarn cheeses one upon another on a spindle that is leakproof, and compressing the stacked yarn cheeses to a stop provided on each press bobbin so that each press bobbin will be compressed to the same extent; and unidirectionally flowing a dye liquor through the pressed yarn cheeses while simultaneously providing periodic pulsations to the dye liquor in the form of periodic reductions and increases in a flow rate and in a flow pressure to such a minimized degree that the dye liquor can pass through the yarn layers on the compressed cheeses, thereby dyeing the yarns evenly.

2. The method for dyeing yarn cheeses as set forth in claim 1, wherein said periodic pulsations include a periodic reducing of the flow rate of the dye liquor to zero.

3. The method for dyeing yarn cheeses as set forth in claim 1, wherein the flow rate of the dye liquor is in the range of 4 to 10 liters/min.

4. The method for dyeing yarn cheeses as set forth in claim 3, wherein the flow rate of the dye liquor is in the range of 6 to 10 liters/min. per 1 kg of cotton yarns.

5. The method for dyeing yarn cheeses as set forth in claim 3, wherein the flow rate of the dye liquor is in the range of 4 to 7 liters/min. for polyester yarns having a winding density after pressing of 0.51 g/cm$^3$ and a winding density before pressing of 0.38 g/cm$^3$.

* * * * *